US007473156B2

(12) United States Patent
Hsieh

(10) Patent No.: US 7,473,156 B2
(45) Date of Patent: Jan. 6, 2009

(54) DOLL SCULPTURE SKELETON

(76) Inventor: Yi-Chung Hsieh, 2F, No. 15-1, Kuohsing Rd., Wanhua Dist., Taipei (TW)

( * ) Notice: Subject to any disclaimer, the term of this patent is extended or adjusted under 35 U.S.C. 154(b) by 323 days.

(21) Appl. No.: 11/507,453

(22) Filed: Aug. 22, 2006

(65) Prior Publication Data

US 2008/0051000 A1 Feb. 28, 2008

(51) Int. Cl.
*A63H 3/36* (2006.01)
*A63H 3/04* (2006.01)

(52) U.S. Cl. ..... 446/373; 446/376; 446/486

(58) Field of Classification Search ..... 446/373–376, 446/379–384, 486
See application file for complete search history.

(56) References Cited

U.S. PATENT DOCUMENTS 3,624,691 A * 11/1971 Robson et al. ..... 446/374
4,964,836 A * 10/1990 Kamei ..... 446/374
5,017,173 A * 5/1991 Shapero et al. ..... 446/374
6,155,904 A * 12/2000 Spector ..... 446/320
6,217,406 B1 * 4/2001 Ross ..... 446/370
6,676,481 B2 * 1/2004 Klaus et al. ..... 446/489
6,746,303 B2 * 6/2004 Beidokhti ..... 446/374
6,800,016 B2 * 10/2004 Wittenberg et al. ..... 446/373

FOREIGN PATENT DOCUMENTS

DE 887474 * 8/1953

* cited by examiner

*Primary Examiner*—Kien T Nguyen
(74) *Attorney, Agent, or Firm*—Rosenberg, Klein & Lee

(57) ABSTRACT

A sculpture skeleton includes a hollow body, a spring one end of which is extended into a hollow head to securely engage with an inner periphery of the hollow head, a first resilient wire, a second resilient wire diagonally extending through the hollow body so as to extend through the chest portion and the abdomen portion of the hollow body, an arm portion and a leg portion respectively mounted around a portion of the first resilient wire and of the second resilient wire which extend out of the chest portion of the hollow body and a base having multiple apertures defined through a side face thereof to allow extension of the first resilient wire, the second resilient wire and the third resilient wire so as to be positioned on top of the base.

2 Claims, 12 Drawing Sheets

DOLL SCULPTURE SKELETON

BACKGROUND OF THE INVENTION

1. Field of the Invention

The present invention relates to a sculpture skeleton, and more particularly to a doll sculpture skeleton enabling the user to change postures of the doll as required.

2. Description of the Prior Art

A sculpture skeleton has been available on the market for years and most are designed for professional sculptors. The professional sculptor uses clay or any suitable material to attach to an outer periphery of the skeleton so as to form a sculpture. Most of the sculpture skeletons are of real size so that they take large space, which is not convenient for beginners. Especially, sculptors living in the metropolitan areas can not afford to have such a large space for storing sculptures.

Recent trend drives the youngsters to make cute little dolls for themselves. As we all know that making a doll also requires a sculpture skeleton so as to stand and pose the sculptor as required. The conventional sculpture skeleton may require screws or nails so as to position the sculpture on a board, which is troublesome and needs to incorporate with auxiliary tools, e.g. hammers, screwdrivers etc.

To overcome the shortcomings, the present invention tends to provide an improved doll sculpture skeleton to mitigate the aforementioned problems.

SUMMARY OF THE INVENTION

The primary objective of the present invention is to provide a doll sculpture skeleton to enable the user to make cute little dolls with different postures.

In order to accomplish the aforementioned objective, the doll sculpture skeleton of the present invention is composed of a hollow head, a hollow body with a chest portion having an assembly rod extending from an end of the chest portion and provided with an annular stop formed on an outer periphery of the assembly rod and an abdomen portion, two arms, two legs, a spring, multiple resilient metal wires and a base.

In yet another objective of the present invention, the spring is mounted around the assembly rod so that after the hollow head is mounted on the assembly rod to allow the free end of the spring to be securely attached to an inner periphery of the hollow head, the head is able to rock.

A further objective of the present invention is that there are three resilient metal wires, a first wire, a second wire and a third wire. The first wire extends diagonally through the hollow body and the second wire also extends diagonally through the hollow body to intersect the first wire. The third wire extends through the hollow body to respectively engage with a portion of the first wire and of the second wire so as to reinforce the structural integrity.

Other objects, advantages and novel features of the invention will become more apparent from the following detailed description when taken in conjunction with the accompanying drawings.

DETAILED DESCRIPTION OF THE PREFERRED EMBODIMENT

Figure 1B:
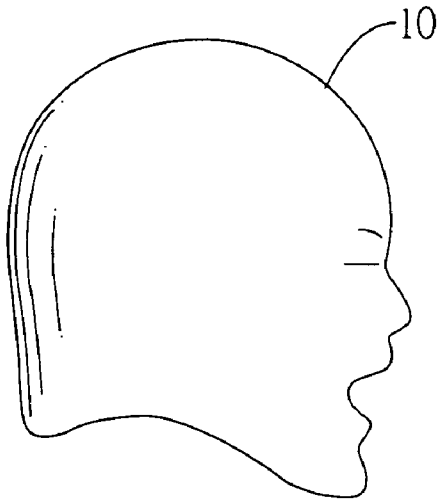
FIG. 1B is a side plan view of the head of the present invention.
Figure 1A:
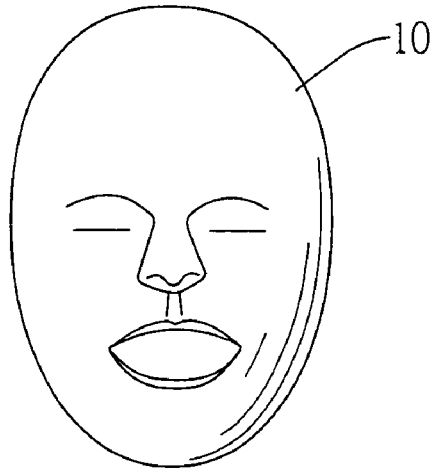
FIG. 1A is a front plan view of the head of the present invention.
Figure 1C:
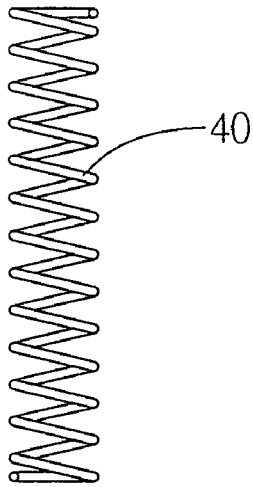
FIG. 1C is a front plan view of the spring of the present invention.
Figure 2B:
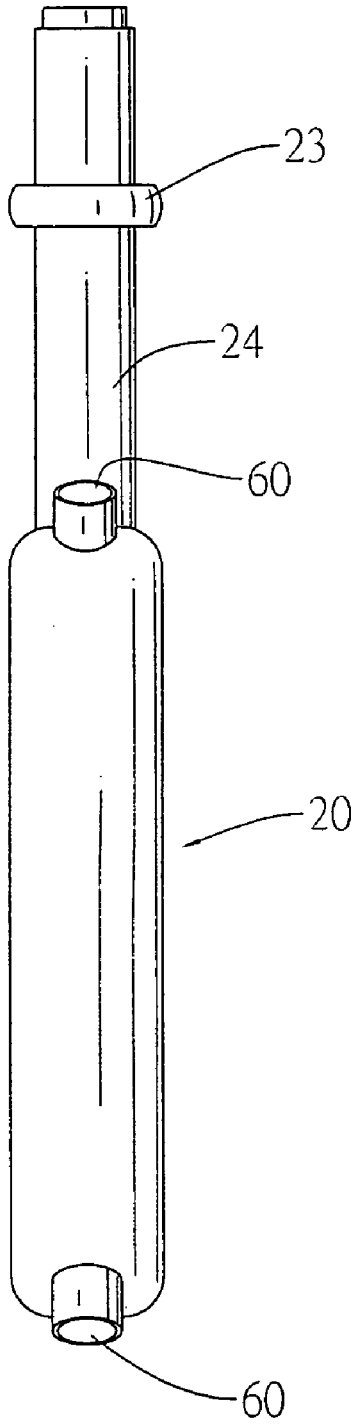
FIG. 2B is a side plan view of the body of the present invention.
Figure 2A:
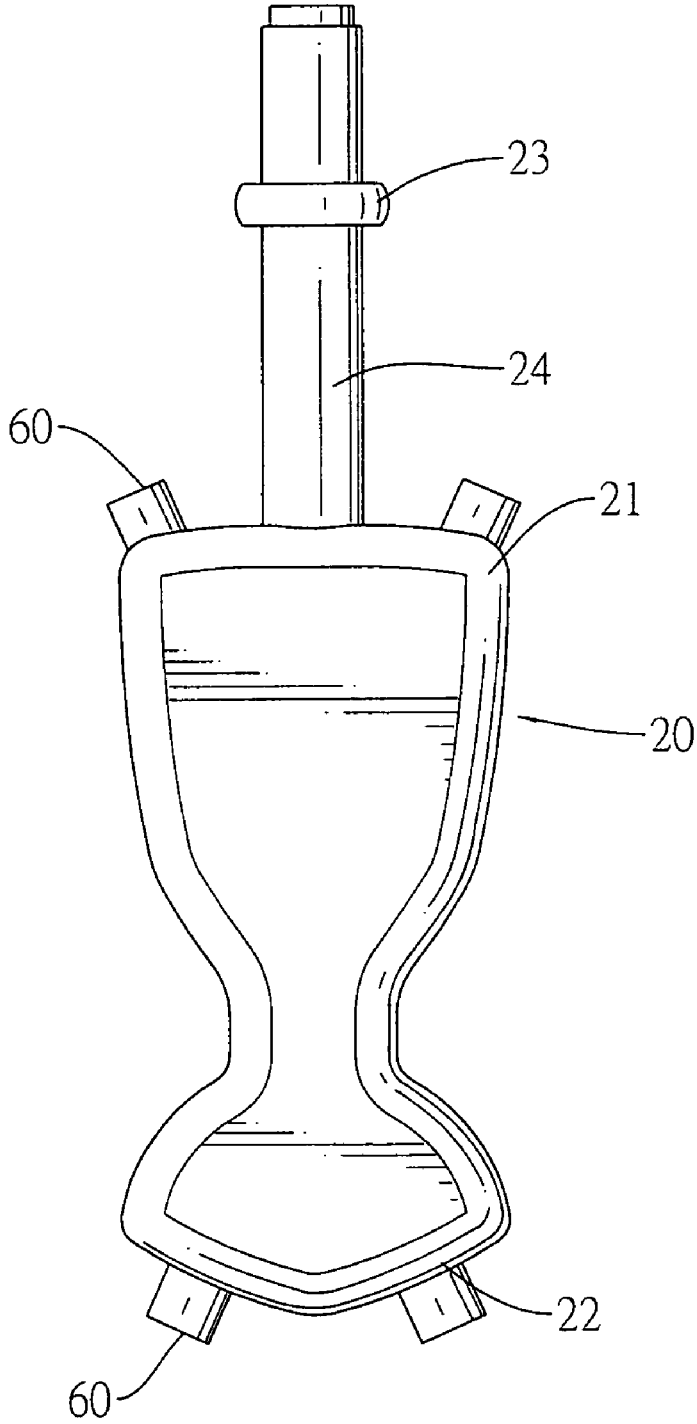
FIG. 2A is a front plan view of the body of the present invention.
Figure 3B:
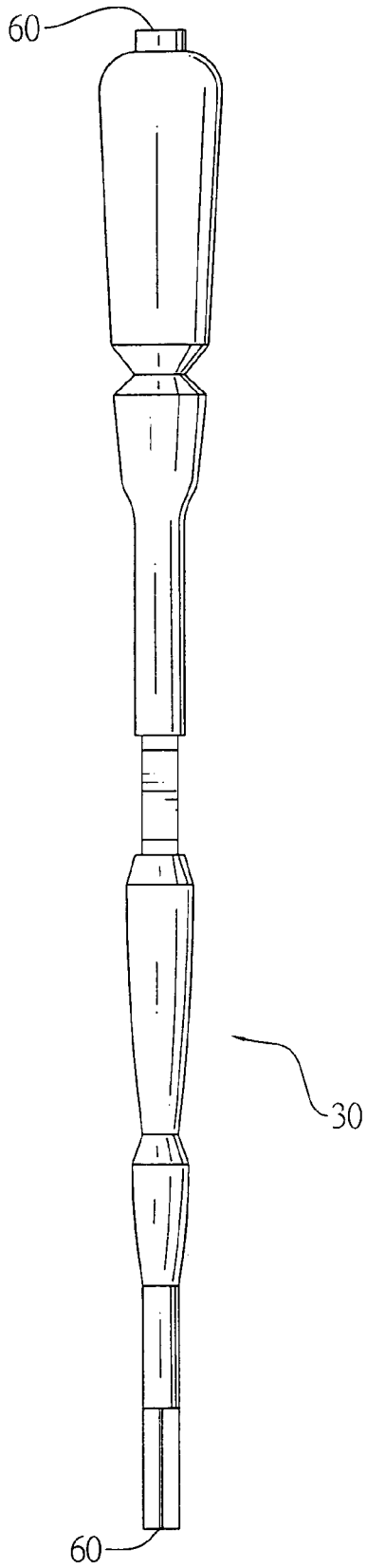
FIG. 3B is a side plan view of the combination of the arm and the leg.
Figure 3A:
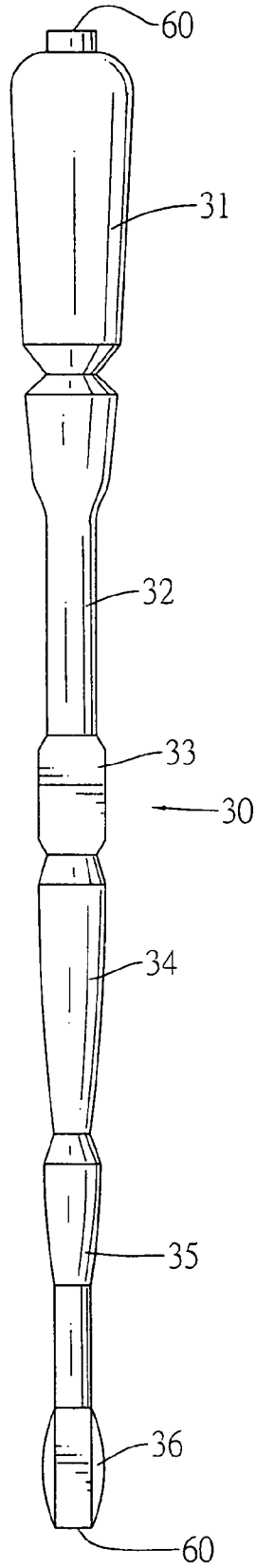
FIG. 3A is a font plan view of the combination of an arm and a leg.

With reference to FIGS. 1A, 1B, 1C, 2A, 2B, 3A, 3B and FIG. 8, it is noted that the doll sculpture skeleton in accordance with the present invention includes a hollow head (10), a hollow body (20), two arm and leg combinations (30), a spring (40), multiple resilient wires (60) and a base (61).

The head (10) is hollow inside and provided with facial features such as eyes, a nose, a mouth etc. and has a bottom opening defined in a bottom face of the head (10).

The hollow body (20) is divided into a chest portion (21) and a abdomen portion (22) integrally formed with the chest portion (21). An assembly rod (24) is extending upward from a side of the chest portion (21) and has an annular stop (23) formed on an outer periphery of the assembly rod (24). Through holes (60) are defined in a face of the hollow body (20) to communicate with an interior of the body (20).

The arm and leg combination (30) is substantially cylindrical and divided into a thigh (31), a lower leg (32), a thenar (33), an upper arm (34), an elbow (35) and a palm (36). Two ends of the arm and leg combination (30) are respectively provided with a through hole (60) to communicate with each portion of the combination (30).

Figure 4:
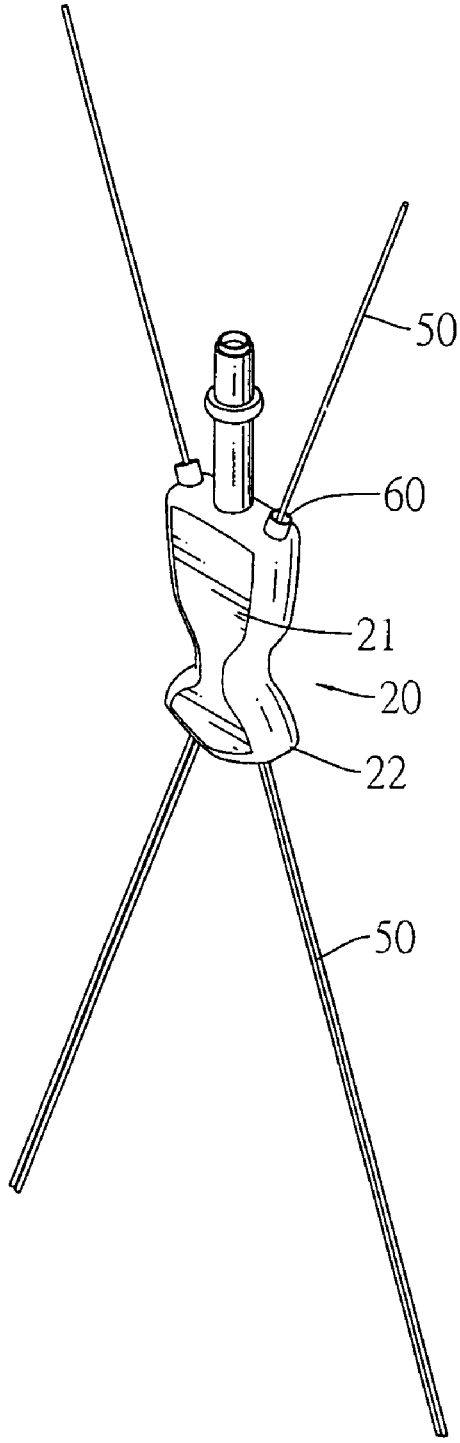
FIG. 4 is a perspective view showing that two wires are diagonally extending through the hollow body.
Figure 5:
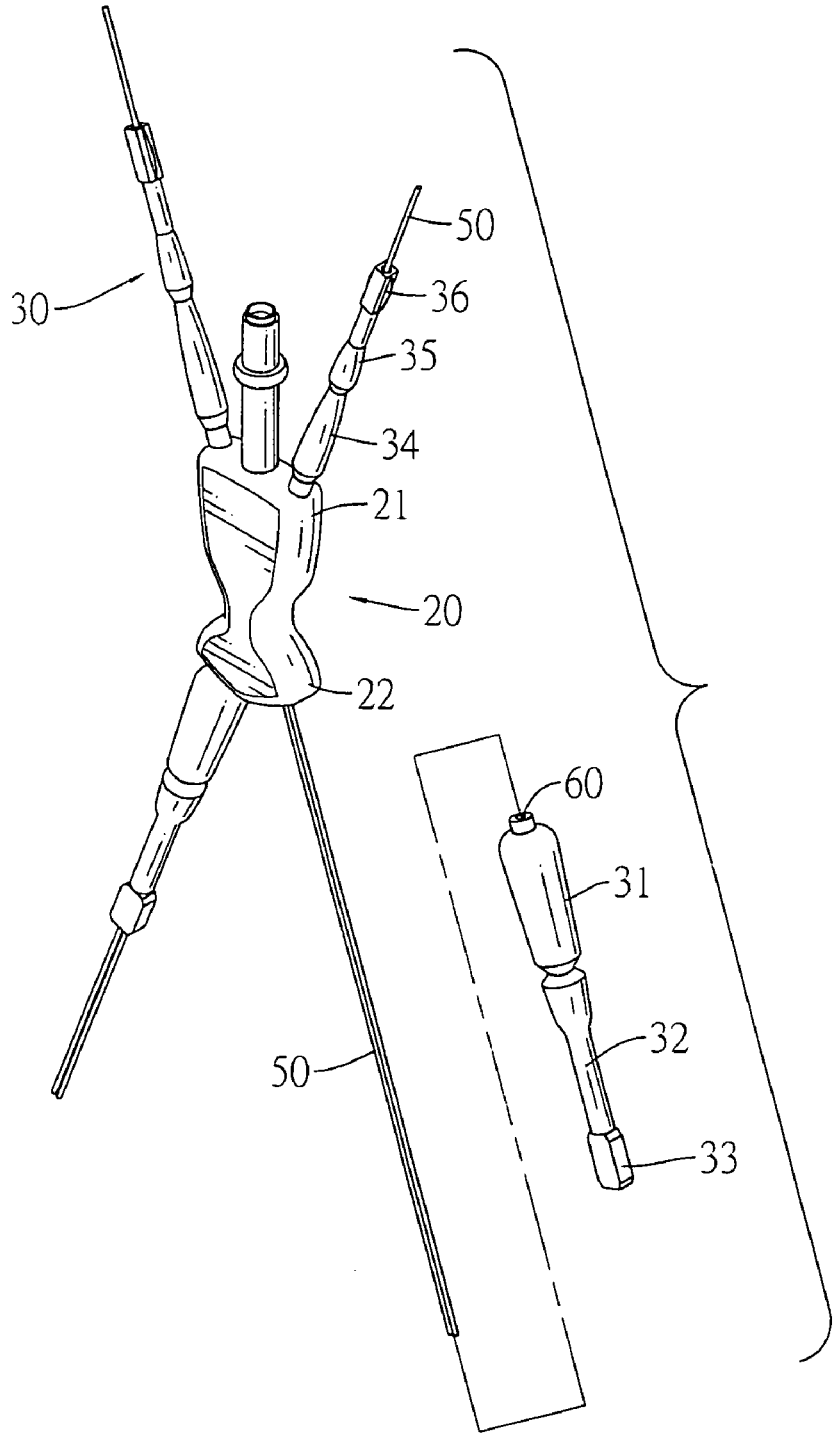
FIG. 5 is a perspective view showing the connection of the leg to the wire which is extended through the body.
Figure 6:
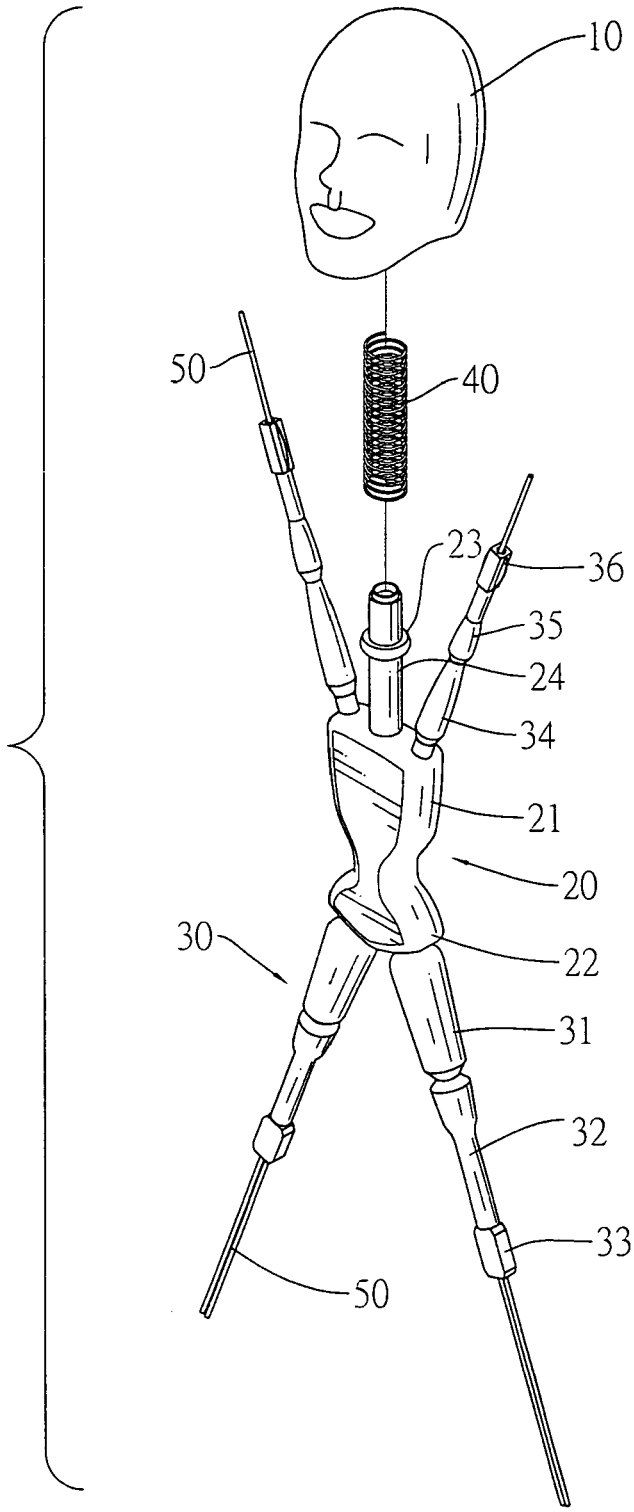
FIG. 6 is a perspective view showing that the spring and the head are to be mounted on the assembly rod extending upward from the body.
Figure 7:
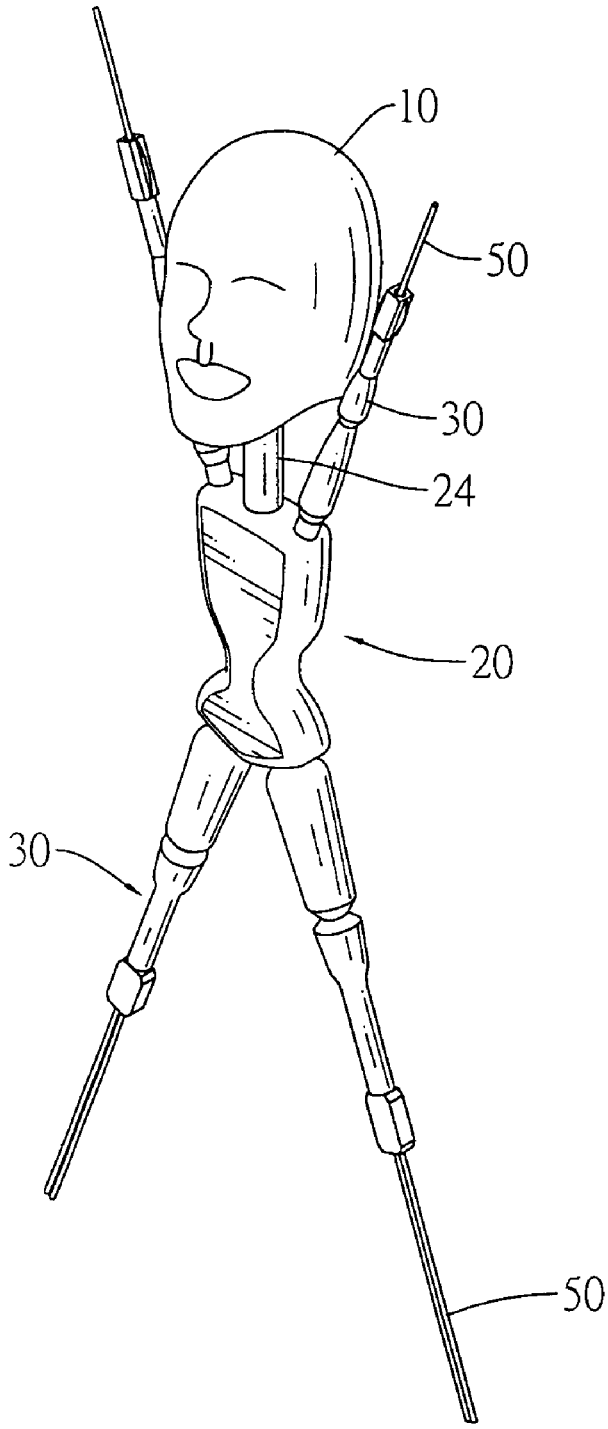
FIG. 7 is a perspective view showing that the doll sculpture skeleton of the present invention is assembled.
Figure 8:
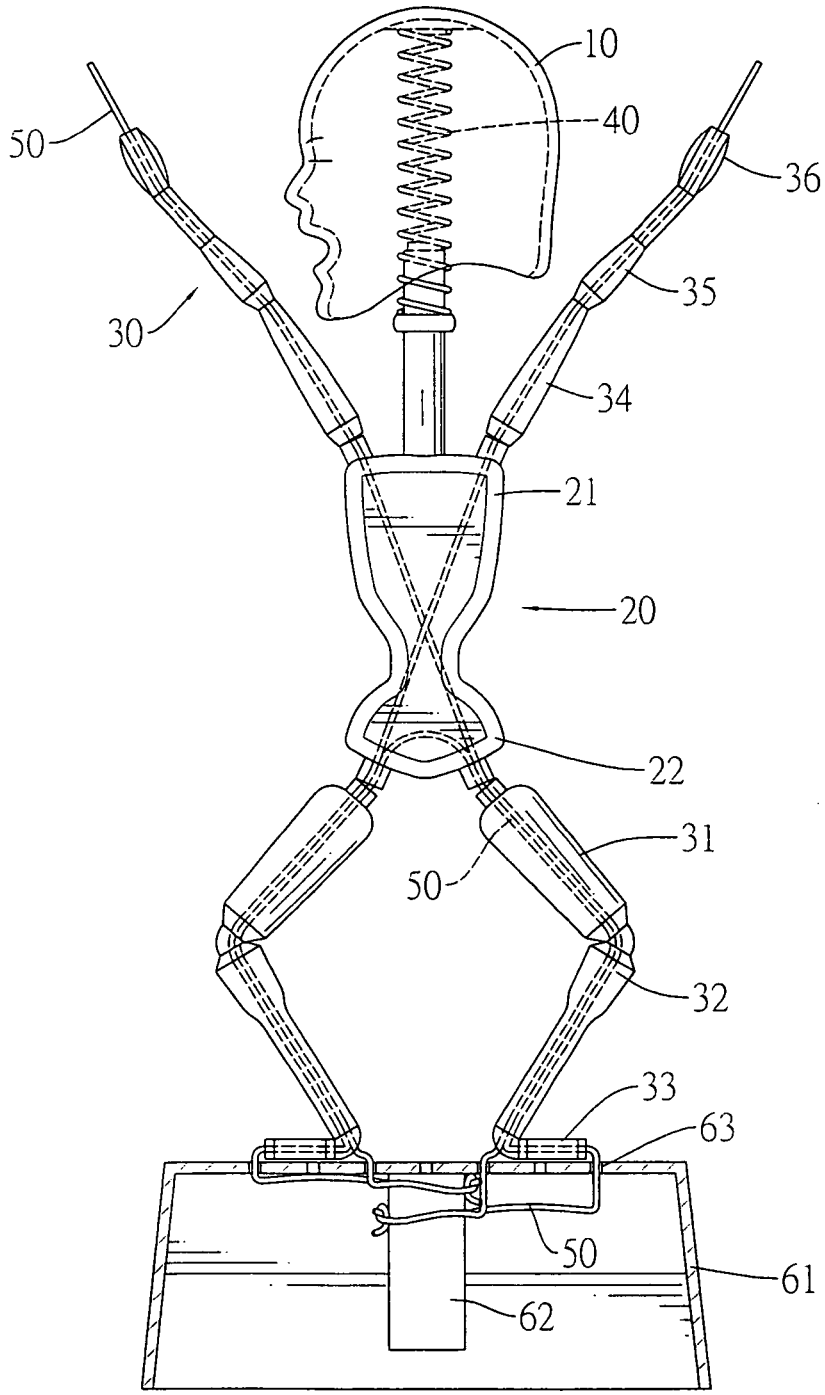
FIG. 8 is a cross sectional view showing the internal structure of the doll sculpture skeleton of the present invention.
Figure 9:
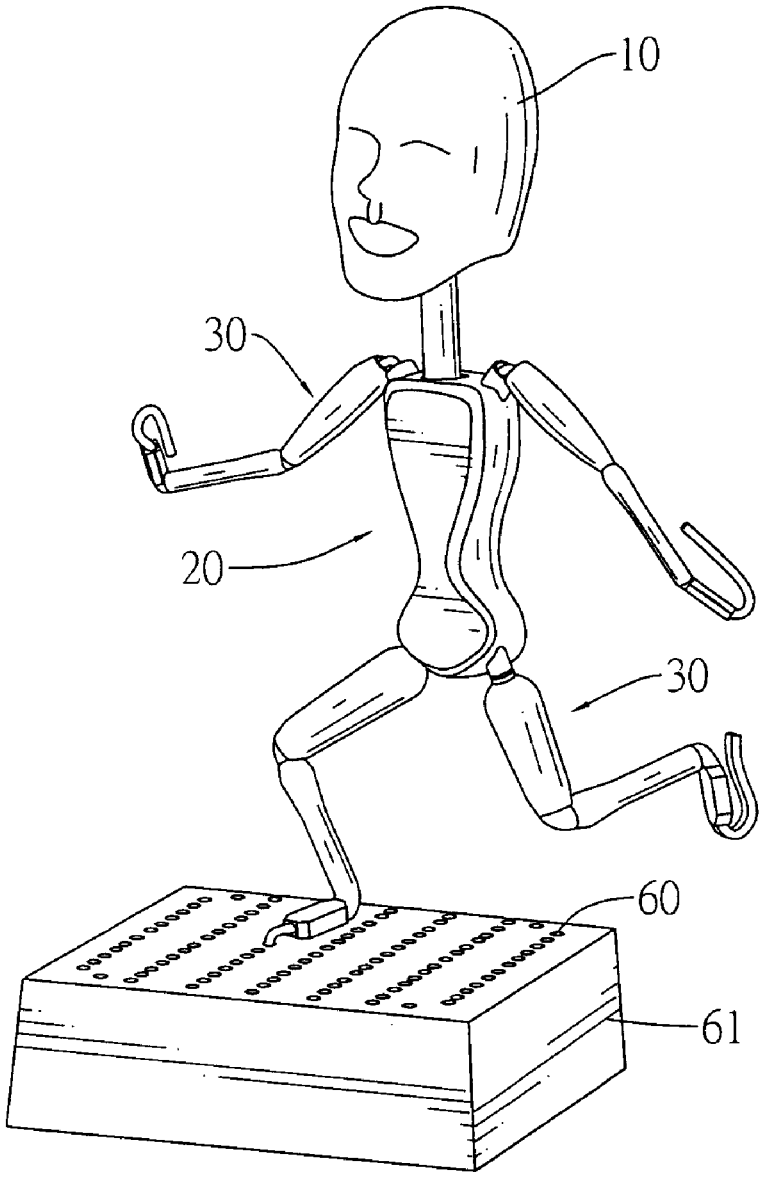
FIG. 9 is a perspective view showing that a running doll is presented.

With reference to FIG. 4, it is noted that preferably there are three resilient wires (50), two of which diagonally extend through the hollow body (20) and the remaining one extends through two adjacent through holes (60) of the hollow body (20) to respectively engage with a portion of each of the two resilient wires (50) so as to reinforce the structural integrity of the doll sculpture skeleton of the present invention.

With reference to FIGS. 5, 6, 7 and 8, after the resilient wires (50) are extended through the hollow body (20), the arm and leg combination (30) is divided into two portions from a joint between the thenar (33) and the upper arm (34). That is the user is able to cut the arm and leg combination (30) to separate the arm and leg combination (30) into two portions, namely the thigh (31), the lower leg (32) and the thenar (33) and the upper arm (34), the elbow (35) and the palm (36). Due to the separation of the arm and leg combination (30), an additional through hole (60) is defined in each of the two portions.

Then two resilient wires (50) extend diagonally through the hollow body (20) and the remaining resilient wire (50) extend through one side of the hollow body (20) to respectively engage with a portion of each of the two diagonally extending resilient wires (50). Thereafter, a portion of the resilient wire (50) extending out of the chest portion (21) of the hollow body (20) extends through the arm portion which includes the upper arm (34), the elbow (35) and the palm (36) and a portion of the resilient wire (50) extending out of the abdomen portion (22) extends through the leg portion which includes the thigh (31), the lower leg (32) and the thenar (33). The spring (40) is mounted on the assembly rod (24) and stopped by the annular stop (23) formed on the outer periphery of the assembly rod (24). A portion of the spring (40) extends out of the assembly rod (24). Then the free end of the spring (40) extends through the bottom opening of the hollow head (10) to securely engage with an inner periphery of the hollow head (10) via adhesive or any suitable manner.

After the aforementioned process is finished, the resilient wires (50) extending out of the two leg portions are secured to a positioning rod (62) which is formed inside the base (61) having multiple apertures (63) defined through a side face of the base (61). Thus the resilient wires (50) are first extended through two corresponding apertures (63) and then secured to the positioning rod (62). Thereafter, the doll sculpture skeleton is finished.

Figure 10:
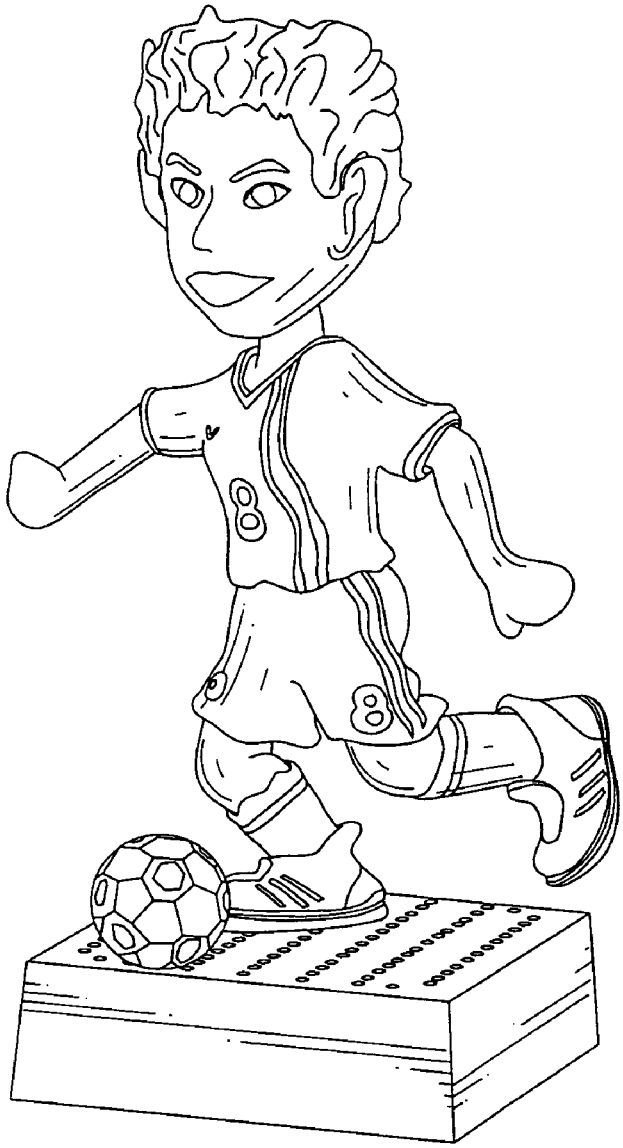
FIG. 10 is a perspective view showing that a doll is playing with a soccer ball
Figure 11:
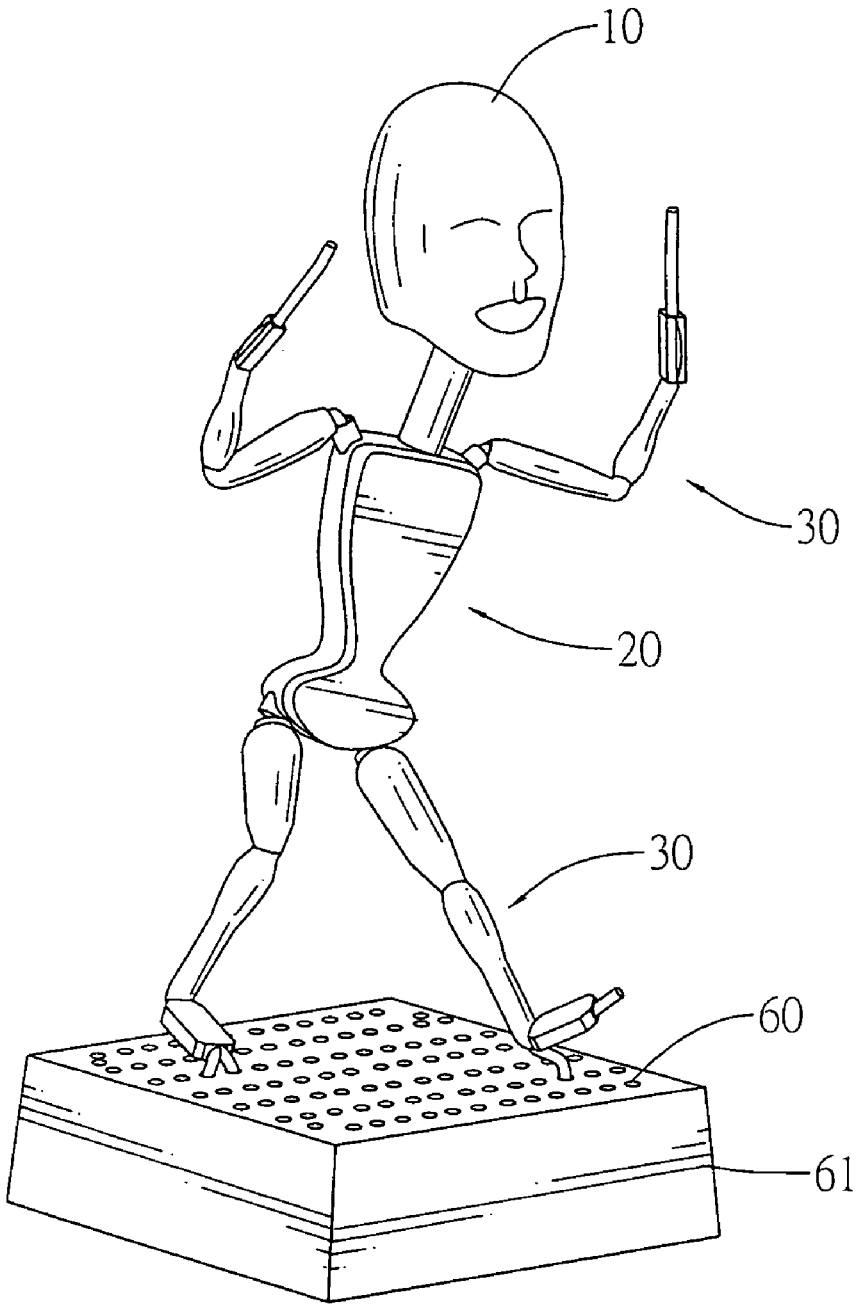
FIG. 11 is a perspective view showing a doll is walking.
Figure 12:
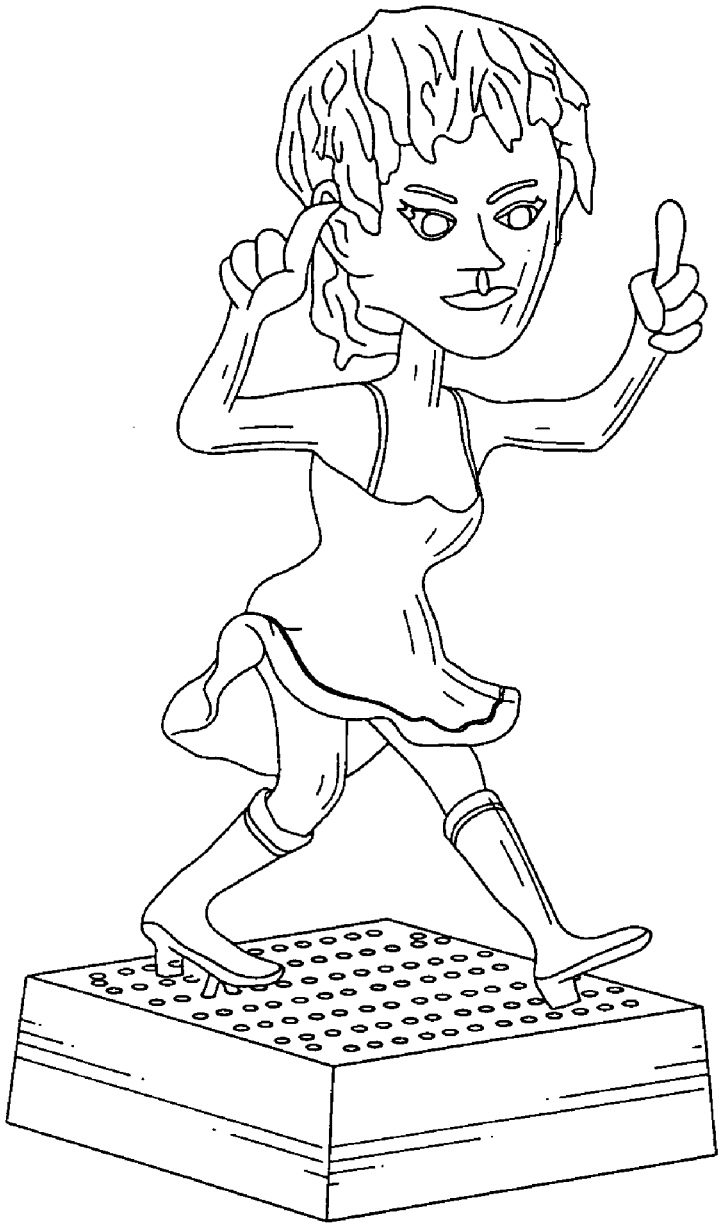
FIG. 12 is a perspective view showing that a doll of different type to that shown in FIG. 11 is walking.

With reference to FIGS. 9, 10, 11 and 12, it is to be noted that due to the resilience of the resilient wires (50), the user is able to simply bend the skeleton to pose as running, playing with a soccer ball after clay is provided outside the skeleton as shown in FIGS. 1 and 10 or walking as shown in FIGS. 11 and 12.

Referring to FIG. 8 again, it is noted that the third resilient wire (50) is extending through the hollow body (20) to respectively engage with a portion of the first and the second resilient wire (50) extending out of the abdomen portion (22) so as to reinforce the structural integrity of the skeleton.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sculpture skeleton comprising:

a hollow body with through holes defined through a side face of the hollow body and divided into a chest portion and an abdomen portion, the hollow body having an assembly rod extending upward therefrom and provided with an annular stop formed on an outer periphery of the assembly rod;

a spring one end of which is mounted on the assembly rod and stopped by the annular stop and the other end of which is extended into a hollow head to securely engage with an inner periphery of the hollow head;

a first resilient wire diagonally extending through the hollow body so as to extend through the chest portion and the abdomen portion;

a second resilient wire diagonally extending through the hollow body so as to extend through the chest portion and the abdomen portion and to intersect the first resilient wire;

an arm portion respectively mounted around a portion of the first resilient wire and of the second resilient wire which extends out of the chest portion of the hollow body;

a leg portion respectively mounted around a portion of the first resilient wire and of the second resilient wire which extends out of the abdomen portion of the hollow body;

a third resilient wire extending through the abdomen portion of the hollow body to respectively engage with a portion of the first resilient wire and of the second resilient wire before the leg portion is mounted therearound; and a base having multiple apertures defined through a side face thereof to allow extension of the first resilient wire, the second resilient wire and the third resilient wire so as to be positioned on top of the base.

2. The sculpture skeleton as claimed in claim 1, wherein the base further has a positioning rod formed inside the base and a portion of the first resilient wire, of the second resilient wire and of the third wire extending out of the leg portion is able to be secured on the positioning rod.

* * * * *